US010798988B2

(12) United States Patent
Brown

(10) Patent No.: US 10,798,988 B2
(45) Date of Patent: Oct. 13, 2020

(54) FOOTWEAR CONSTRUCTION

(76) Inventor: Paul Anthony Brown, Trenton (CA)

( * ) Notice: Subject to any disclaimer, the term of this patent is extended or adjusted under 35 U.S.C. 154(b) by 956 days.

(21) Appl. No.: 13/245,954

(22) Filed: Sep. 27, 2011

(65) Prior Publication Data

US 2013/0055595 A1 Mar. 7, 2013

(30) Foreign Application Priority Data

Sep. 2, 2011 (CA) ..... 2751586

(51) Int. Cl.
*A43B 1/00* (2006.01)
*A43B 3/00* (2006.01)
*A43C 9/02* (2006.01)

(52) U.S. Cl.
CPC ..... *A43B 3/0078* (2013.01); *A43B 1/0018* (2013.01); *A43C 9/02* (2013.01)

(58) Field of Classification Search
CPC ..... A43B 3/0078; A43B 1/0018; A43C 9/02
USPC .... 36/45, 48, 136, 2.6, 3 R, 3 A, 88, 93, 29, 36/3 B, 35 B; 417/472, 423.9; 415/121.2
See application file for complete search history.

(56) References Cited

U.S. PATENT DOCUMENTS 396,548 A 1/1889 Dexter
2,759,284 A 10/1954 Santisi
2,889,639 A 9/1957 Rudine
2,982,033 A 5/1961 Bingham, Jr.
3,319,360 A 5/1967 Nadler
4,096,650 A 6/1978 Seidel
4,446,634 A * 5/1984 Johnson et al. ..... 36/29
4,495,173 A 1/1985 Matsunaga
4,611,416 A 9/1986 Lin
4,697,362 A 10/1987 Wasserman
4,852,276 A 8/1989 Savoca
4,977,891 A 12/1990 Grim
5,375,430 A 12/1994 Siegel
5,379,533 A * 1/1995 Swartz ..... 36/136
5,515,622 A 5/1996 Lee
5,569,021 A * 10/1996 Hopkins ..... G01N 1/14 250/576
5,839,211 A 11/1998 Pallera
6,068,761 A * 5/2000 Yuen ..... C02F 1/003 210/266
6,282,815 B1 9/2001 Caston
6,665,957 B2 12/2003 Levert
6,711,836 B2 3/2004 Weiss
(Continued)

FOREIGN PATENT DOCUMENTS

RU 2448626 * 4/2012 ..... A43B 7/06
WO WO 1991/10376 7/1991
(Continued)

*Primary Examiner* — Katharine Gracz
(74) *Attorney, Agent, or Firm* — Elan IP Inc.

(57) ABSTRACT

A footwear article having a cartridge enclosing a fluid, the cartridge including a cartridge inlet and a cartridge outlet, and a fluid circulation system for circulating the fluid into the cartridge inlet and out of the cartridge outlet. The fluid circulation system may include a pump having a pump inlet in fluid communication with the cartridge outlet and a pump outlet in fluid communication with the cartridge inlet. Preferably, the cartridge further encloses particulate matter suspendable in the fluid. The pump may be a bellows pump. The cartridge is preferably interchangeable and can be attached and detached from the footwear article.

18 Claims, 16 Drawing Sheets

(56) References Cited

U.S. PATENT DOCUMENTS

| | | | | |
|---|---|---|---|---|
| 6,775,932 | B2 | 8/2004 | Lin | |
| 7,013,581 | B2 * | 3/2006 | Greene | A43B 7/08 36/114 |
| 7,096,606 | B2 | 8/2006 | Rau | |
| 7,421,806 | B2 | 9/2008 | Braynock | |
| 7,497,036 | B2 | 3/2009 | Rhodes | |
| 2002/0194747 | A1 | 12/2002 | Passke et al. | |
| 2004/0114353 | A1 | 6/2004 | Romeo | |
| 2004/0255490 | A1 * | 12/2004 | Wan et al. | 36/137 |
| 2005/0013711 | A1 * | 1/2005 | Goyetche | B01D 46/0023 417/423.9 |

FOREIGN PATENT DOCUMENTS

| | | |
|---|---|---|
| WO | WO 2002/098256 | 12/2002 |
| WO | WO 2011/019961 | 2/2011 |

* cited by examiner

FOOTWEAR CONSTRUCTION

CROSS-REFERENCE TO RELATED APPLICATIONS

This application claims priority to Canadian Patent Application No. 2,751,586, filed Sep. 2, 2011.

FIELD OF THE INVENTION

The present invention relates generally to footwear and foot-covering articles, and more particularly to a footwear construction with a fluid circulating system for visually altering the appearance of the footwear.

BACKGROUND OF THE INVENTION

Conventional footwear having transparent, semi-transparent and translucent areas that can visibly display the wearer's sock, liner, logos, designs or other insert, including articles added to the exterior surface of the shoe are known in the art.

Jellies®, Melisa Love System® Adidas Clima Response/Cool® or Nike Air Max Rival® all provide footwear with transparent features attached or incorporated into the footwear. Nike Air Force II Espo® provides a sneaker with transparent areas and an associated blue sock with a white swoosh, representing the company's logo, to be displayed through the footwear.

U.S. Pat. No. 4,611,416 to Lin discloses an athletic shoe having a quarter and outer material covering portions thereof providing a window in the covering and an access opening into the space between the quarter and outer material for viewing the contents within the pocket or information display cards or the like disposed within the space behind the window. U.S. Pat. No. 4,697,362 to Wasserman discloses removable suspended particulate for footwear or clothing and, more particularly, for removably applying an identifying suspended particulate, design, slogan, or other print to items of clothing, but particularly footwear which can be removed and replaced with hook and pile technology. U.S. Pat. No. 4,852,276 to Sebastian and Savoca relates to a shoe, such as an athletic shoe, having a replaceable logo or design. The patents issued to Lin, Wasserman, Sebastian are limited in their ability to provide a footwear article having a changeable appearance.

U.S. Pat. Nos. 2,982,033, 3,319,360 and 4,096,650 to Bingham, Nadler and Seidel, respectively disclose transparent boots that use a liner to influence the appearance of the boot in which the liner is permanently attached during the manufacturing process. Additionally, U.S. Pat. No. 5,379,533 to Swartz discloses a fluid filled amusement or attention attracting article for attachment to footwear secured to the exterior of the footwear. U.S. Pat. No. 6,711,836 to Weiss discloses the concept of an exchangeable device to alter the appearance of footwear in the form a removable member, an elongated insole.

U.S. Pat. No. 7,096,606 to Fu discloses a shoe with a decorative showcase that has a shoe body and transparent case selectively attached to a position on the shoe body wherein the transparent case contains at least one kind of liquid and multiple floating objects in different shapes floating in at least one kind of liquid. The Fu teaching fixedly attaches the transparent case to the shoe and limits its use on other areas of the shoe. U.S. Pat. No. 5,839,211 to Pallera discloses a novelty shoe with a display assembly including an outer translucent member fixedly attached to the surface of the shoe containing a decorative element within a translucent compartment. Pallera is fixedly attached and limited in its capacity to exchangeably replace the display assembly it discloses.

U.S. Pat. No. Des 396,548 to Ng discloses an ornamental design for a fluid-filled decorative element for a child's shoe. U.S. Pat. No. 2,759,284 to Santisi discloses an ornament displaying sandal of novel construction affording means for receiving and displaying an ornament contained within a portion of the sandal enclosed with a transparent plastic cover. Santisi's ornament displaying sandal is limited in that it displays one item that is installed in the shoe during its original manufacture and cannot be easily removed or replaced. U.S. Pat. No. 2,889,639 to Rudine discloses an improvement to hollow plastic footwear commonly called "clogs" whereby the base of the hollow area of the clog serves as a medium for the reception of various ornamental objects and a fluid whereby the objects may float and otherwise be animated as an attraction for children or the like. U.S. Pat. No. 7,497,036 to Rhodes-Vivour discloses an apparatus utilizing filters, a pump and air pouch to vary a footwear's color. Rudine is limited in capacity to a change of footwear color only. U.S. Pat. No. 6,775,932 to Lin discloses an air bladder device that includes a casing having a transparent or semi-transparent wall that can be manually inflated to display set patterns in the shoe.

Several additional patents exist that incorporate pumps into footwear. U.S. Pat. No. 5,515,622 to Lee discloses a ventilation system for footwear having an upper sole assembly in which perforations or openings in the sole assembly connect the interior of the shoe to a duct or passage into a pumping chamber or airbag for ventilation purposes. U.S. Pat. No. 5,375,430 to Siegel discloses a compressor-expander heating or cooling system incorporated into a heel of a shoe which is powered by reciprocal gravity pressures upon the shoe which occur naturally while walking. U.S. Pat. No. 6,665,957 to Layert and Krafsur discloses spring-cushioned shoes with the springs sealed within vacuities formed in the heel and ball areas of the soles of the shoes with a fluid passageway providing fluid communication between several vacuities. U.S. Pat. No. 4,495,173 to Spier discloses a foot-actuated pump in a shoe, boot or sneaker which is connected to one or more expandable air bladders located in footwear to provide and maintain a good fit. U.S. Pat. No. 4,977,891 to Grim discloses an ankle brace with inflatable bladders with a pump attached that is activated by walking or running. The U.S. Pat. Nos. 5,515,622, 5,375,430, 6,665,957, 4,495,173 and 4,977,891 noted above, provide shoe systems that incorporate a pumping system for purposes of ventilation or comfort of fit.

The method of fluid transfer in footwear is also illustrated in a number of inventions for the purposes of achieving shock absorption in footwear. U.S. Pat. No. 6,282,815 to Caston which discloses an invention relating to the transfer of fluid to achieve shock absorption in footwear, and in particular to fluid transfer for shock absorption and ankle support adjustable to compensate for differences in shoe size or body weight of the user. Another example of footwear employing fluid for shock absorption is U.S. Pat. No. 4,446,634 to Johnson et al, discloses a shoe containing fluid in both a shock absorption bladder in a heel portion and ball portion of the shoe.

The foregoing references illustrate that the prior art has limited examples of fluid transfer incorporated into footwear manufactured with transparent display areas for display and design altering purposes. In particular, U.S. Patent Application No. 2004/0114353 to Romeo discloses a light-scattering vessel attached to the footwear. The attached vessel is not removably attachable and therefore limited in its capacity to provide footwear that can be easily altered to aesthetically please the wearer.

U.S. Pat. No. 7,421,806 to Braynock and Gabriele demonstrates a transparent display system to alter or change the appearance of footwear by combining footwear with a sock or inner liner. Braynock and Gabriele disclose a transparent display panel filled with fluid, but this transparent panel is a fixedly attached sealed compartment of the shoe that cannot be readily altered thereby limiting its ability to change the contents of its appearance thereby limiting the capacity to alter the appearance of the shoe. Furthermore, the visual effects capable of being produced by this patent are limited.

U.S. Pat. No. 5,379,533 to Swartz and U.S. Pat. No. 7,096,606 to Fu, U.S. Design Pat. No. D396,548 to Ng, and U.S. Pat. No. 2,889,639 to Rudine, all demonstrate prior art that incorporates fluid to alter or change the appearance of footwear, however the prior art in these cases is limited to the one design that the self-contained, pre-filled bladders or sealed compartments offer, thereby limiting the ability to be interchangeable. Additional prior art noted above demonstrates that the transfer of fluid within footwear is primarily employed to achieve a better fit, shock absorption or to enhance cushioning, or to improve athletic performance or in some cases, provide ventilation.

The prior art documents described above are limited in their capacity to provide a footwear article having a changeable appearance, and furthermore, are unable to provide a footwear article that incorporates changeable appearance features while allowing for the circulation of a fluid to further enhance the appearance of the footwear article.

SUMMARY OF THE INVENTION

In accordance with one embodiment of the invention, there is provided a footwear article having a sole portion, an upper portion, a heel portion, and an interior for receiving a foot; the footwear article including a cartridge enclosing a fluid, the cartridge including a cartridge inlet and a cartridge outlet, and a fluid circulation system for circulating the fluid into the cartridge inlet and out of the cartridge outlet. The fluid circulation system preferably includes a pump having a pump inlet in fluid communication with the cartridge outlet and a pump outlet in fluid communication with the cartridge inlet.

According to one aspect of the invention, the cartridge further encloses particulate matter suspendable in the fluid.

According to another aspect of the invention, the pump comprises a bellows pump. According to another aspect of the invention, the pump comprises a micro pump. Various other types of pumps are also contemplated by the invention.

According to another aspect of the invention, there is provided an inlet filter proximate the cartridge inlet and an outlet filter proximate the cartridge outlet; the inlet and outlet filters sized and otherwise dimensioned to prevent the particulate matter from being carried by the fluid out of the cartridge.

According to another aspect of the invention, there is provided an inlet tube having a first end connected to the cartridge inlet and a second end connected to the pump outlet and an outlet tube having a first end connected to the cartridge outlet and a second end connected to the pump inlet.

According to another aspect of the invention, there is provided a pressure activated valve provided in each of the inlet and outlet tubes, wherein the pressure activated valves prevent movement of the fluid outside of the cartridge when the pump is inoperative.

According to another aspect of the invention, the cartridge is provided on one of the upper, the heel portion and the interior of the footwear.

According to another aspect of the invention, the cartridge comprises an elongated flexible tube adapted to replace a shoelace.

According to another aspect of the invention, the cartridge further includes a fill port for injecting fluid into the cartridge.

According to another aspect of the invention, the fill port comprises a vacuum fill port and includes a self-sealing plug.

According to another aspect of the invention, the cartridge is made of a transparent, semi-transparent or translucent material.

According to another aspect of the invention, the cartridge is made of one or more materials selected from the group comprising polyvinyl chloride, thermoplastics, urethane, polycarbonate, acrylic, silicone and polypropylene.

According to another aspect of the invention, the cartridge further includes a convex surface portion.

According to another aspect of the invention, there is provided at least one light source arranged to illuminate the fluid.

According to another aspect of the invention, the cartridge is removable from the footwear.

According to another aspect of the invention, there is provided one or more channels formed on a surface of the upper; the cartridge including one or more rails adapted to be received in the one or more channels for securing the cartridge to the upper.

According to another aspect of the invention, there is provided one portion of a hook and loop fastener on the upper; the cartridge including another portion of the hook and loop fastener for attaching the cartridge to the upper.

According to another aspect of the invention, the fluid is selected from the group comprising water, mineral oil, glycerin, glycol, saline and combinations thereof.

According to another aspect of the invention, the particulate matter is selected from the group comprising polyester glitter, acrylic polyesters, micas, bismuth ox chloride and combinations thereof.

According to another embodiment of the invention, there is provided a footwear article including a sole portion, an upper portion, a heel portion, an interior for receiving a foot, and a cartridge enclosing a fluid and suspendable particulate matter; wherein the cartridge is removably connected to at least one of the sole portion, the upper portion, the heel portion and the interior.

According to another embodiment of the invention, there is provided a footwear article having a sole portion, an upper portion, a heel portion, and an interior for receiving a foot; the footwear article comprising a cartridge enclosing a fluid and a fluid circulation system for circulating fluid into the cartridge and out of the cartridge. The fluid circulating system including a pump having a pump arranged to receive fluid from the cartridge and to pump fluid to the cartridge.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1:
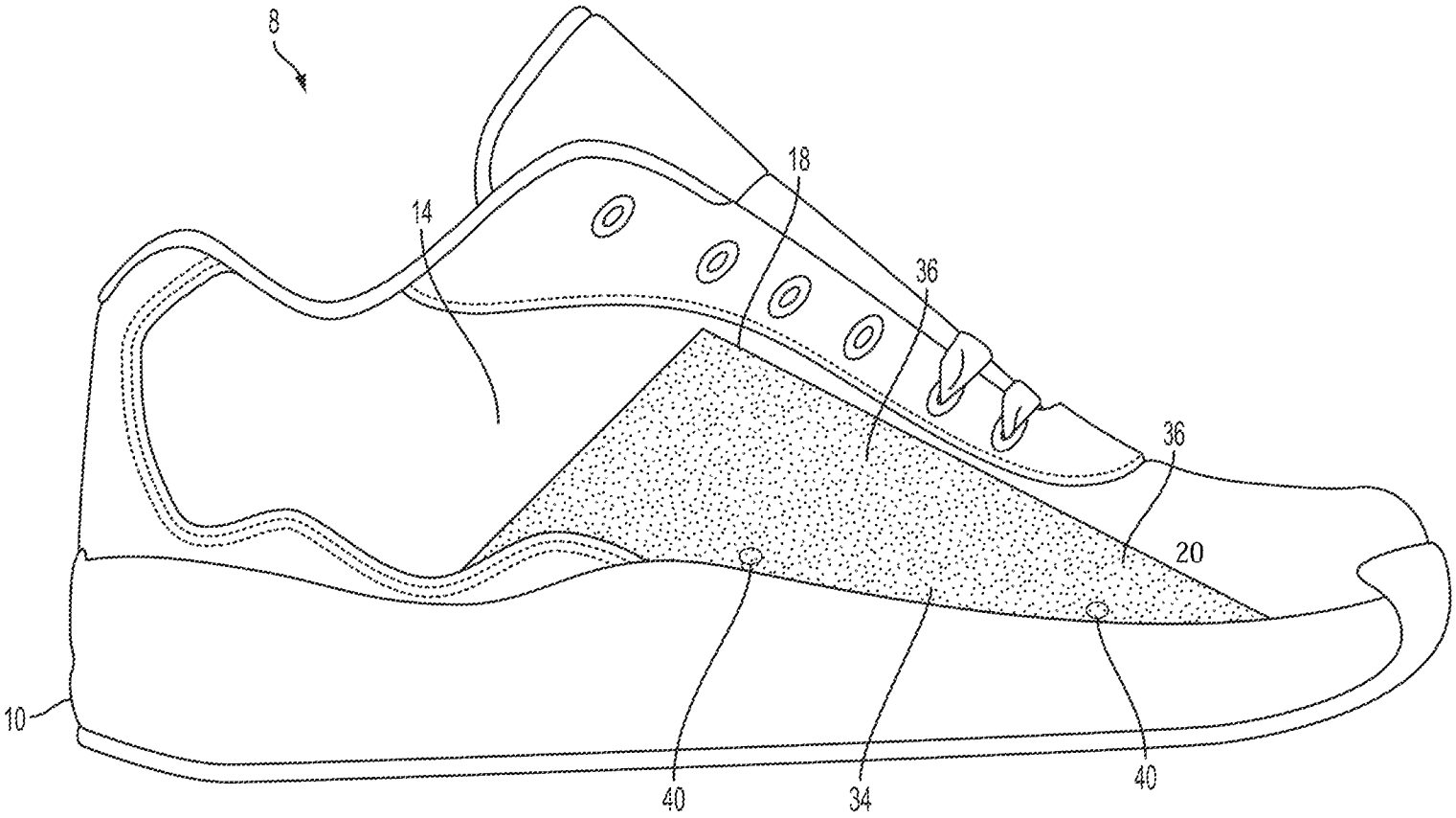
FIG. 1 shows a side view of a footwear article according to the invention.

The following description will first provide a general overview of the function and advantages provided thereof with respect to the invention, followed by a description of the preferred embodiments as illustrated in the Figures.

One desirable function for footwear fashion is the ability to employ footwear accessories that visibly change or alter the appearance of footwear or allow the user to personalize or individualize a desired footwear design. The invention provides a user with various ways of changeably altering the appearance of the footwear. This adaptable feature is a highly desirable and value-added component for footwear, particularly children's footwear.

In general, there is provided a fluid circulating system for footwear that permits the communication of fluid within the footwear to changeably alter the appearance of either the interior or exterior areas of the footwear or a combination of both, including, but not limited to changing the appearance of the interior of the footwear and the exterior surface areas on the upper, heel, toe, laces or other parts of the footwear as will be appreciated by a person skilled in art having regard to the description herein. The invention preferably also allows the user to rapidly, easily and effectively alter the appearance of the footwear making the footwear a highly marketable consumer feature.

Various embodiments of the invention also provide a fluid circulating system assembled within the footwear including either a singular collapsible pump chamber or a combination of multiple collapsible pumps chambers heretofore referred to as the pump. In an alternative embodiment, a micro pump such as a piezo-electric pump may be used. The illustrated and preferred pump of the present invention is a bellows i.e., a generally cylindrical, hollow structure with accordion-type walls. Bellows are preferred, for example, because they can be made resiliently to act like a spring. Furthermore, the pump is designed in such a manner that it collapses according to a predetermined pattern. The bellows pump has a structure which is flexible such that it can be manually compressed, thereby reducing the volume within the pump and is preferably sufficiently resiliently biased that it returns to its initial shape when the manual compression force is released.

The invention provides for cartridges that sealably contain various forms of fluid including but not limited to liquid, gas or plasma. Further, the fluid may be in various forms including but not limited to water, mineral oil or glycerin or a mixture of fluids including but not limited to water and mineral oil, glycerin and water, glycerin and mineral oil, water and glycol and or saline or any combination of the above noted fluids. The fluid contained in the cartridge may also contain suspended particulate matter having a plurality of different shapes and sizes Suspended particulate matter includes, but is not limited to, colorized polyester glitter, a pearlant chemical gannet that imparts a glitter or a sparkle when exposed to natural or artificial light, or be colorized acrylic polyesters, metallic and non-metallic micas, bismuth ox chloride, and combinations thereof which visually enhances the ornamentation and aesthetic appearance of the footwear.

All particulate matter glitter shapes can be added to the fluid contained within the cartridge and include but are not limited to shapes such as, glitter, cartoon characters, the sun, moon, planets, stars, animals, sea creatures, fish, dinosaurs, snowflakes, hearts, crescents, tear drops, crosses, triangles, fruit, given names, commercial logos, professional sport logos images of the likeness of sports celebrities, movies stars, rock stars and other recording artists, and may be personalized to reflect the wearer's name and the like. The suspended particulate matter can be pre-determined geometrical and non-geometrical shapes and can include but not limited to silhouettes or holographic images. As an example of the versatility of the present invention, one cartridge incorporated on the footwear of the left foot may contain suspended particulate glitter-shaped planets while the cartridge on the footwear of the right foot may contain suspended particulate glitter-shaped stars.

Mechanical action resulting from ambulation while wearing footwear containing the fluid circulating system of the present invention, engages the fluid circulating system to allow the communication of fluid from a pump either securely contained individually or in combination in the heel or toe portion of the footwear, by way an outlet tube or a combination of outlet tubes connected to the sealably contained interior of the fluid-filled cartridges, thereby causing constant agitation of the fluid sealably contained within the cartridges. Continued ambulation while wearing the footwear containing the fluid circulating system forces the fluid to circulate within the cartridge and eventually pass from the cartridge through an outlet tube that transports a portion of the fluid back through the pump. Further ambulation will continue the circuitous flow of the fluid from the pump, through the outlet tubes and into the exchangeable fluid cartridges through the outlet tube that communicates the fluid with the pump and so on, causing a constant agitation of the fluid that can contain various suspended particulate that is visually pleasing and attracts attention.

In order to put these elements and outcomes of the invention into practice, various preferred embodiments are illustrated in the Figures and described in more detail below.

Figure 2:
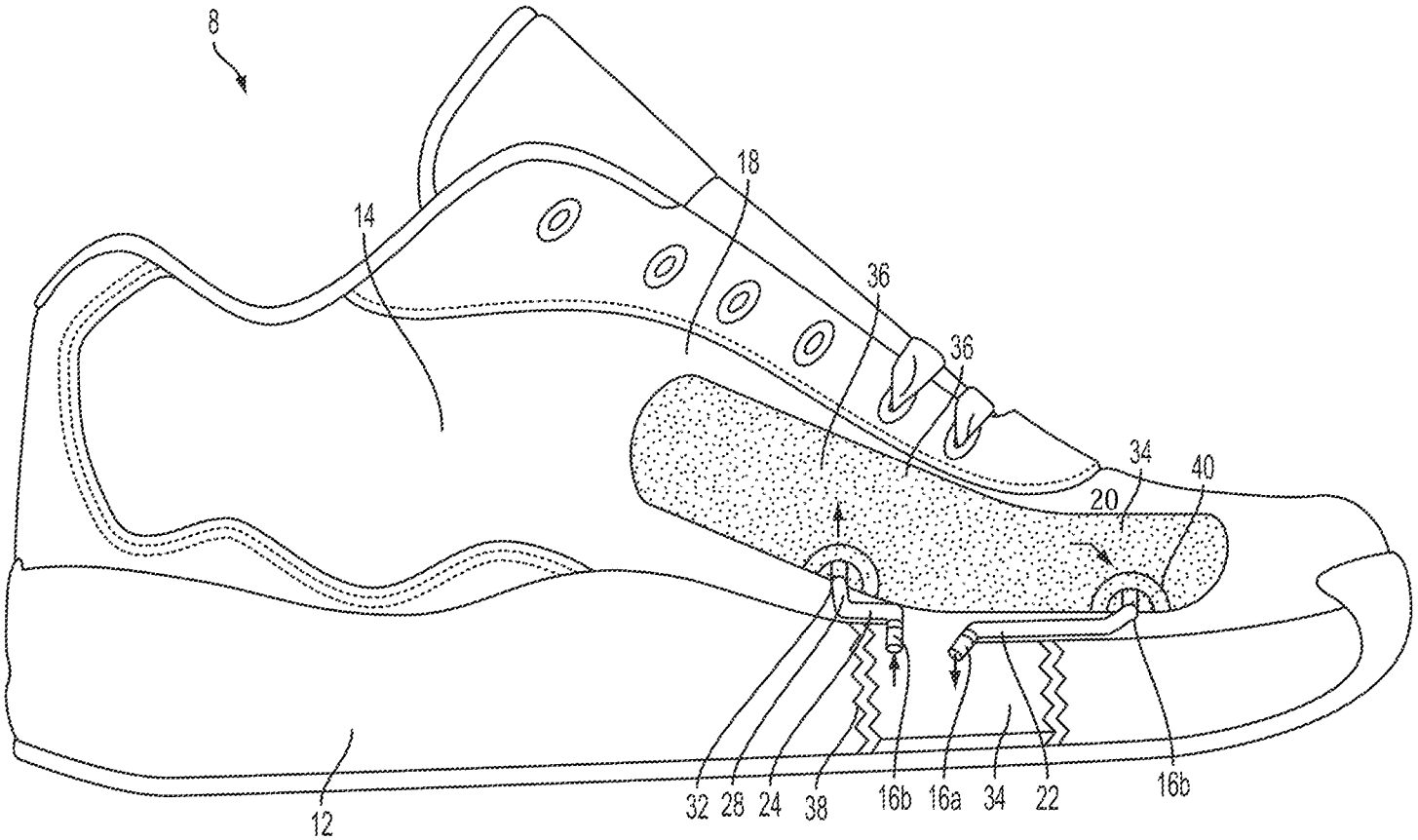
FIG. 2 shows the footwear article of FIG. 1 with a portion of the upper cut away to show the fluid circulation system according to the invention.

Referring now to FIG. 1 and FIG. 2, there is shown a type of footwear to which the present invention is readily adapted, namely, an athletic shoe 8 includes a heel 10, sole 12, and an upper 14. The upper 14 of the footwear contains a removably attachable, sealably contained transparent, semi-transparent or translucent exchangeable fluid cartridge, herein referred to as 'cartridge' 18. The cartridge 18 is inserted into the attachment area of the upper 20 of the shoe 8 that is pre-manufactured to match the shape and contour of the cartridge 18. Various ways of attaching the cartridge 18 onto the attachment area 20 are contemplated and discussed further below. It will be understood by those skilled in the art that any means of attaching the cartridge 18 to the attachment area 20 are possible, and the invention is not limited to particular ways of attachment. The cartridge 18 contains a fluid 34 with suspended particulate 36 sealably contained within the cartridge 18. Upon ambulation, the fluid 34 contained within the pump 38 communicates with the cartridge 18 through outlet tube 24 and agitates the indicia 36 contained within the cartridge 18. Continued ambulation causes the fluid 34 to further communicate through the inlet filter 40 that restricts the flow of the indicia 36 thereby preventing it from communicating through the inlet tube 22 and back into the pump 38.

FIG. 2 shows the shoe 8 with a section of the sole 12 broken away to show the fluid circulating system. without the cartridge 18 securely attached to the attachment area 20. Upon ambulation, the fluid 34 contained in the pump 38 is forced to communicate through the opening in the outlet tube 24. The force of the fluid 34 opens the outlet valve 16*b* and the fluid communicates through the outlet tube 24 and through the cartridge outlet filter 42 and into the cartridge 18. The fluid 34 agitates the indicia 36 suspended in the fluid 34 to flow freely throughout the cartridge 18. As ambulation continues the fluid 34 communicates through the inlet filter 40 and opens the inlet valve 16*a* which allows the fluid 34 to re-enter the pump 38. In one embodiment of the invention, the cartridge inlet and outlet could be provided by a single tube such that when fluid is pumped into the cartridge, it travels through the single tube and when fluid is pumped out, it exits through the same tube.

Figure 3:
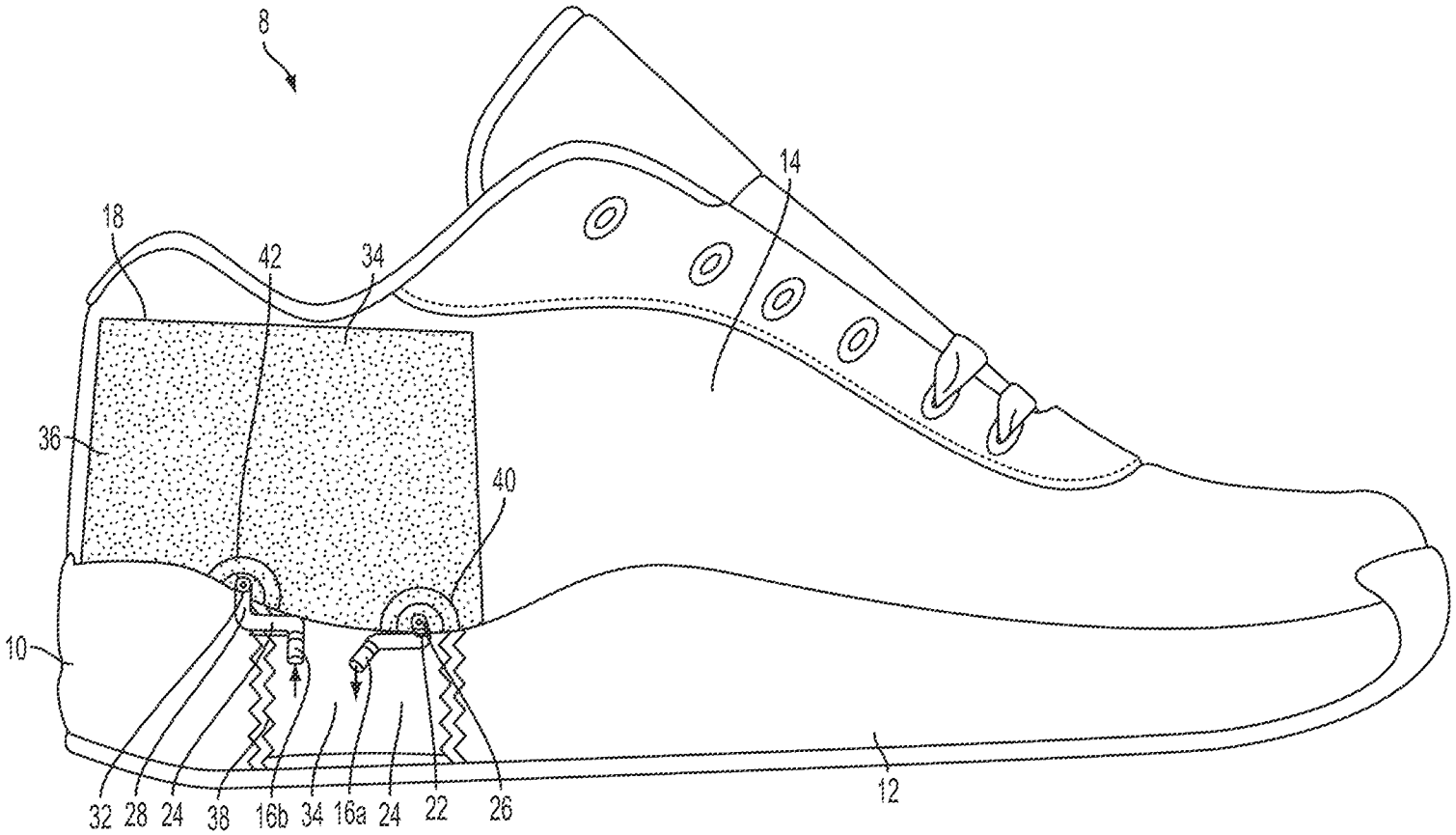
FIG. 3 shows a side view of another embodiment of a footwear article according to the invention.

FIG. 3 shows another embodiment of the invention where the cartridge 18 is affixed to an attachment area at a heel portion of the shoe via the coupling of the cartridge inlet tube 26 and the cartridge outlet tube 28 with the inlet tube 22 and the outlet tube 24. Upon coupling, the rigid contoured ends of the inlet tube 22 and the outlet tube 24 advance into the opening of the cartridge inlet tube 26 and the cartridge outlet tube 28 and push open the cartridge inlet tube valve 30 (shown in detail in FIG. 4) and the cartridge outlet tube valve 32 there by securing the cartridge 18 with the upper 14 of the shoe 8. When the coupling of the cartridge 18 to the attachment area 20 is complete, the fluid 34 containing suspended particulate 36 sealably contained within the cartridge 18 is free to communicate with the pump 38. To ensure that the suspended particulate 36 remain within the cartridge 18 the cartridge inlet tube 26 and the cartridge outlet tube 28 are affixed with an inlet filter 40 and an outlet filter 42 that screen the suspended particulate once the fluid circulating system is engaged via mechanical ambulation of the user wearing the footwear with the fluid circulating system of the present invention. The inlet filter 40 and the outlet filter 42 prevent the indicia 36 from entering the inlet tube 22 and the outlet tube 24 thereby allowing the fluid 34 in the cartridge 18 to distill suspended particulate-free through the outlet tube 24 and communicate with the pump 38.

Figure 4:
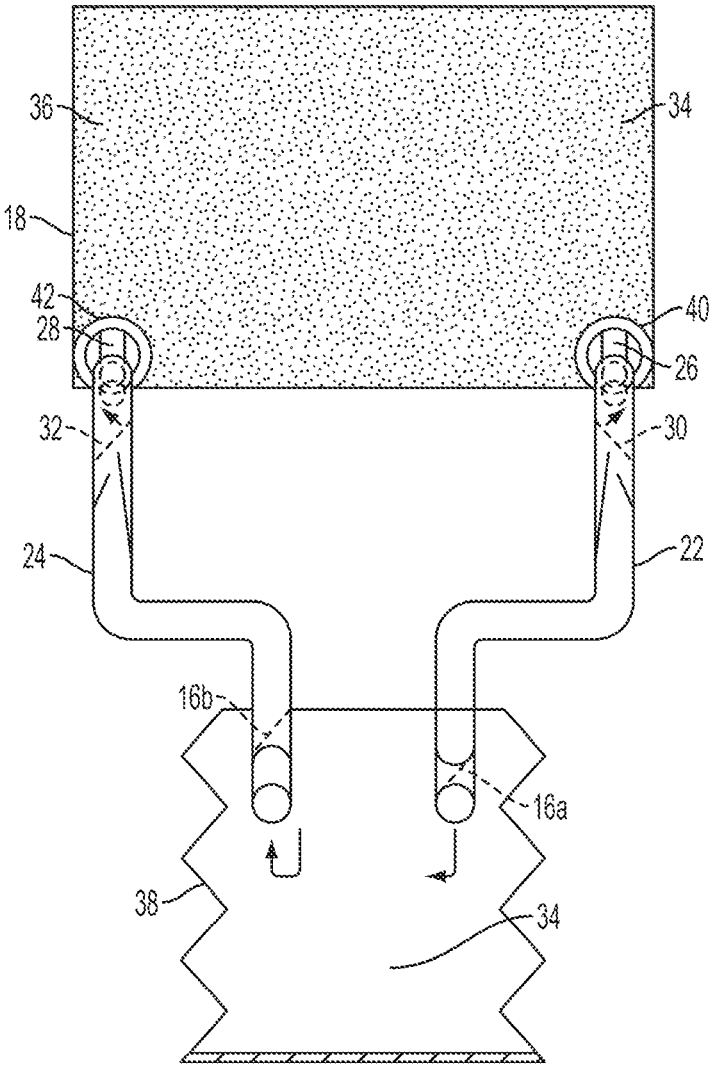
FIG. 4 shows a schematic view of one embodiment of the fluid circulation system according to the invention.

As shown in FIG. 4, the cartridge 18 contains a cartridge outlet tube 28 and a cartridge inlet tube 26 that marry with the rigid contoured ends of the outlet tube 24 and the inlet tube 22 that are preferably pre-manufactured on the shoe 8. The ends of the outlet tube and the inlet tube engage and forcibly open the cartridge outlet tube valve 32 and the cartridge inlet tube valve 30 thereby opening a passage to allow the fluid 34 to communicate with the fluid sealably contained in the cartridge 18. Upon continued ambulation of the user wearing the footwear containing the fluid circulating system of the present invention the walls of the pump 38 collapse and pressurize the fluid 34 to communicate through the outlet tube 24 and thereby engage and open the outlet tube valve 16*b* allowing the fluid 34 into the cartridge 18 that sealably contains fluid 34 and suspended particulate 36. The current caused by the rushing of the fluid 34 into the cartridge 18 agitates the suspended particulate 36. As the user raises the shoe 8 the walls of the pump return to their resiliently biased open position and pressurize the flow of the fluid 34 through the inlet filter 40 and communicate the fluid 34 through the cartridge inlet tube 26 and further communicate the fluid 34 into the inlet tube 22 where it engages and opens the inlet valve 16*a* thereby allowing the fluid 34 to re-enter the pump 38.

Figure 5:
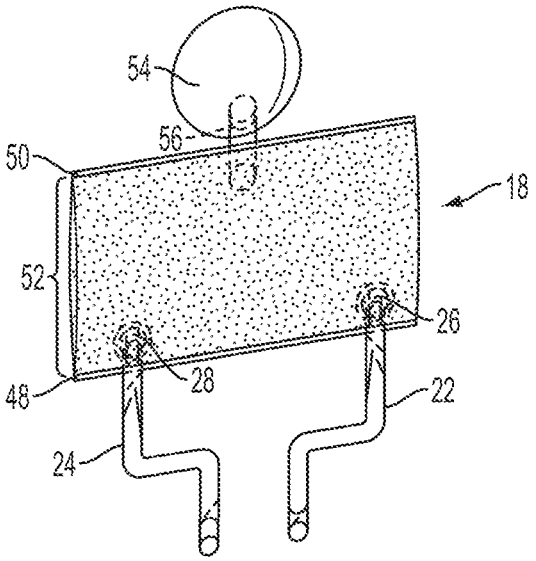
FIG. 5 shows a schematic view of another embodiment of the fluid circulation system according to the invention.
Figure 6:
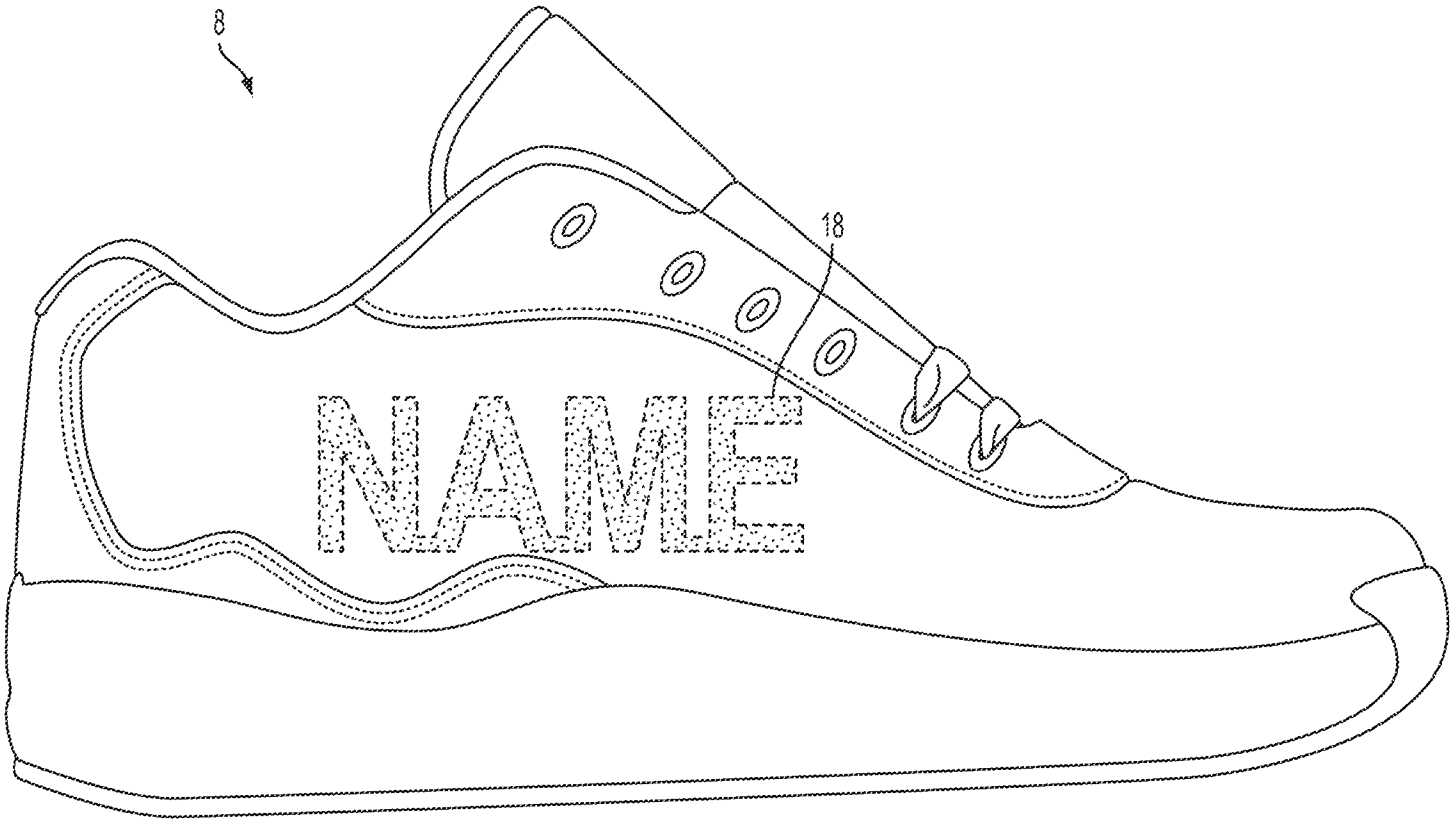
FIG. 6 shows a side view of another embodiment of a footwear article according to the invention.

As shown in FIG. 5, the cartridge 18 displayed in the present diagram includes bottom wall 48 and a top wall 50 which defines the fluid-tight space 52 therebetween. Extending from the bottom wall, the cartridge inlet tube 26 and the cartridge outlet tube 28. Extending from the top wall 50 is a vacuum fill port 54. The fill port 54 may be of any one of a variety of configurations suitable for receiving a fill nozzle for injecting a quantity of fluid into the fluid-tight space 52. The vacuum fill port 54 preferably contains a self sealing plug 56 that self-seals after the fill operation has been completed. The vacuum fill port 54 is shown in FIG. 6 as having a circular shape, but it will be appreciated that vacuum fill port 54 may adopt one of a variety of shapes or configurations suitable for receiving and forming a fluid-tight seal with a self-sealing plug 54 of similar design as the one depicted in this figure. The cartridge 18 is may be made of transparent, semi-transparent translucent materials. Such materials include but are not limited to; polyvinyl chloride (PVC), thermoplastic urethane, poly carbonate, acrylic, silicone or polypropylene. The cartridge 18 is preferably formed by laminating two sheets of transparent, semi-transparent or translucent material leaving a narrow, material free vacuum fluid-tight space 52 that will readily receive fluid 34.

FIG. 6 shows one use of the invention, wherein the cartridge 18 may be formed into various shapes including, but not limited to, words, numbers, objects, logos, cartoon characters, symbols or personalized in the shape of a name. This embodiment may be worn by wearers wishing to showcase a name or logo, show support for a sports team, for example, or be provided to employees such that the name of the employer is visible on the shoe. As will be appreciated by those skilled in the art, off-the-shelf shoes incorporating the fluid circulating system of the invention may be provided in bulk to customers, who could then have custom cartridges made to be attached to the shoe in accordance with the teachings of the invention.

Figure 7:
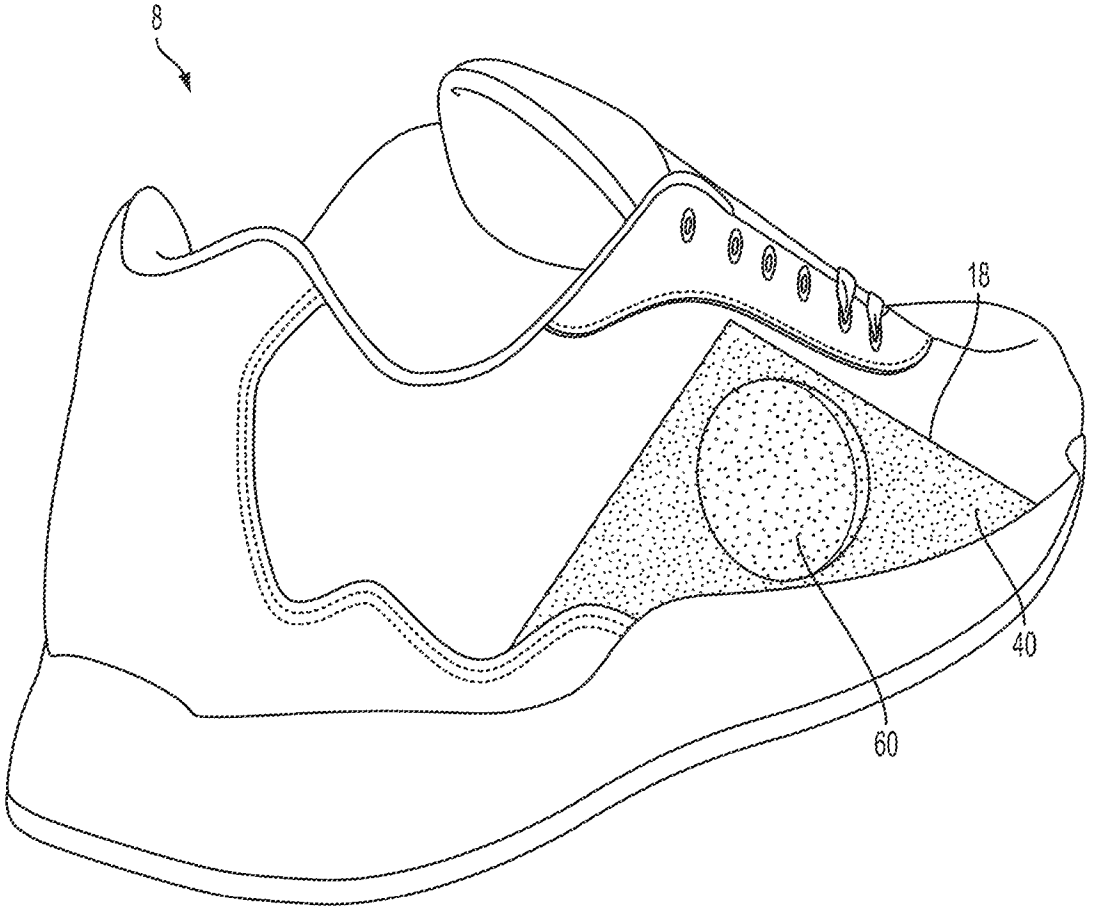
FIG. 7 shows a side view of another embodiment of a footwear article according to the invention.
Figure 8:
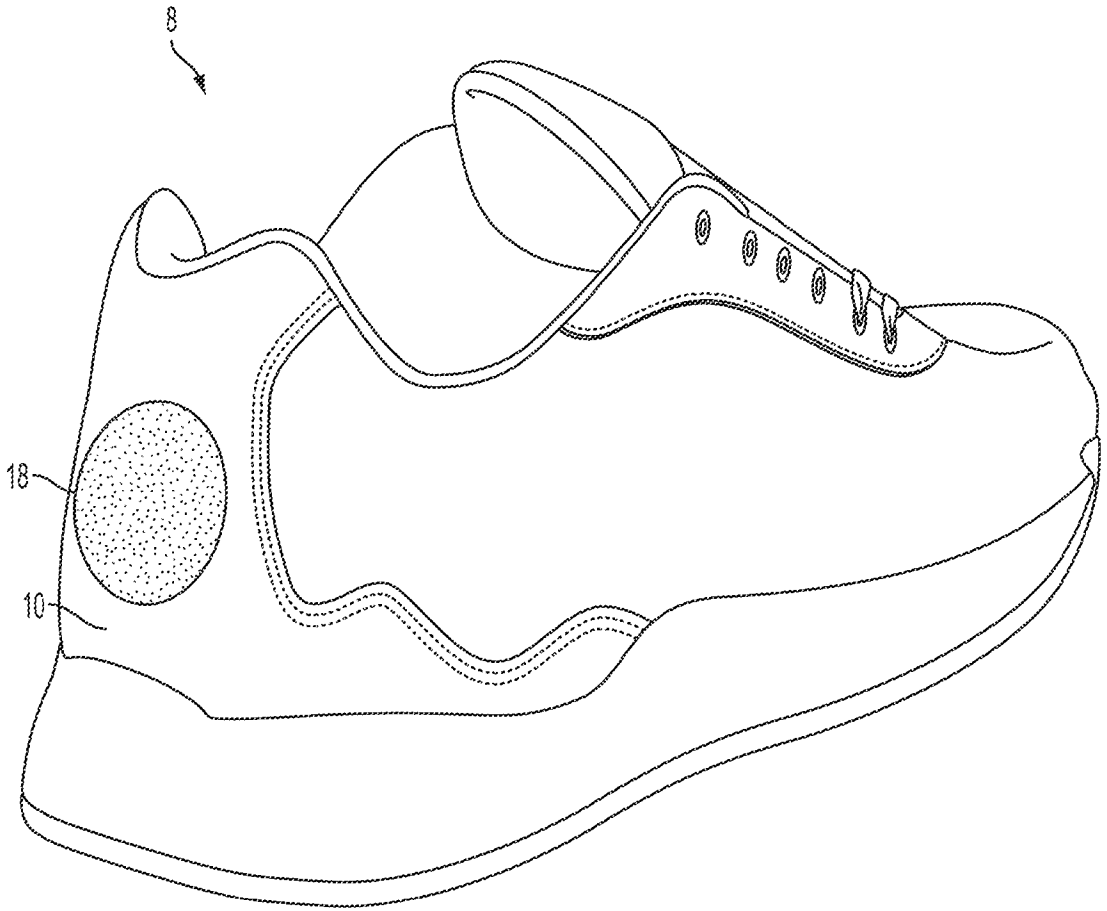
FIG. 8 shows a side view of another embodiment of a footwear article according to the invention.

Referring now to FIG. 7, in order to enhance the size of suspended particulate suspended in the fluid 34 inside the cartridge 18, a transparent, semi transparent or translucent cartridge window 60 can be shaped in the form of a convex lens that is curved outward to form a dome thereby magnifying the suspended particulate inside the hollow display area to make it appear larger to the eye. The shoe 8 can be manufactured to position the cartridge 18 anywhere on the shoe 8 and be of any size, small, medium or large. FIG. 8 demonstrates the cartridge 18 located in the heel 10. For example, the particulate matter may be in the shape of fish that appear to be swimming in the cartridge, and appear larger in size when one or more particulate fish are in the convex portion of the cartridge.

Figure 9:
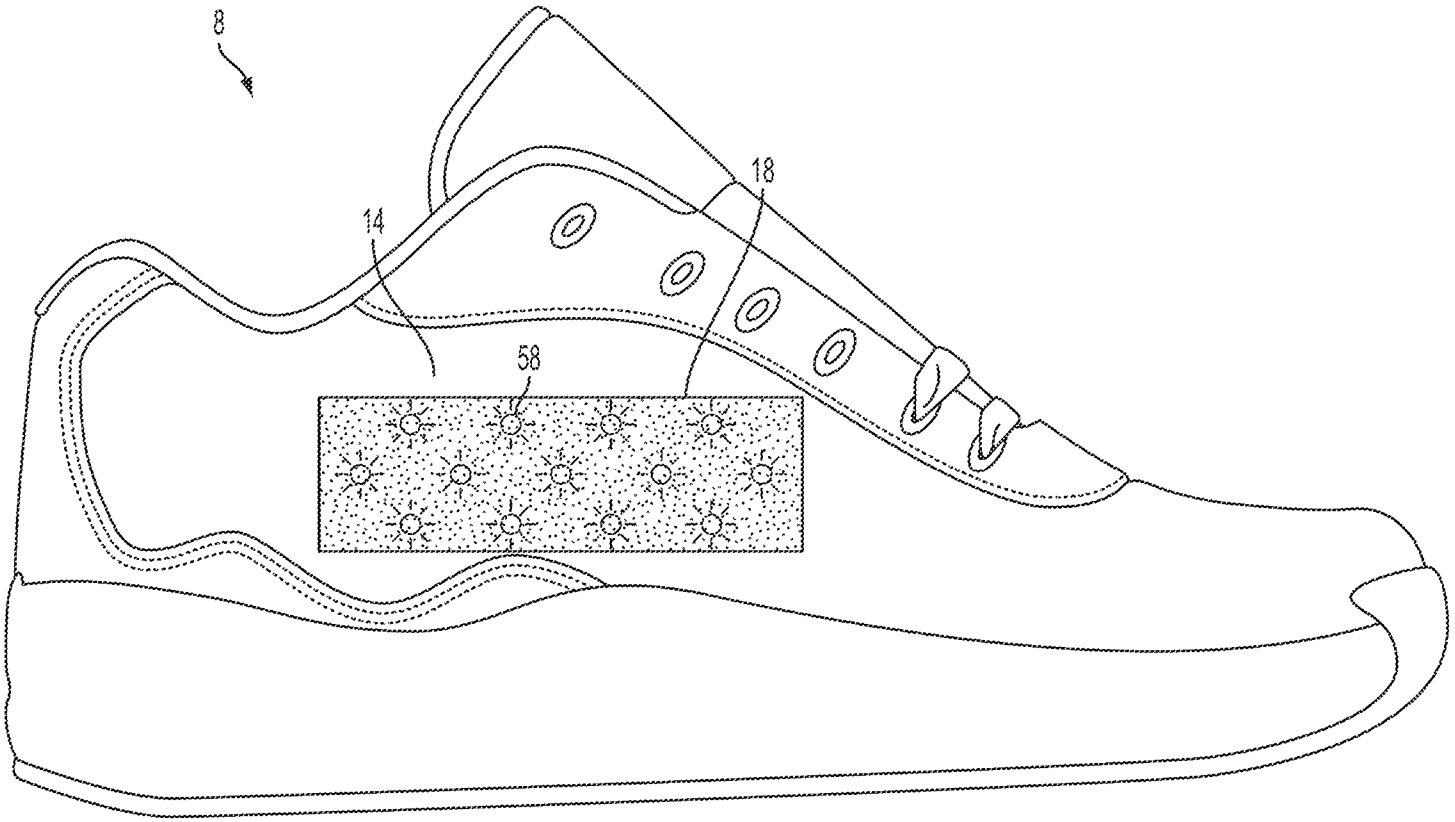
FIG. 9 shows a side view of another embodiment of a footwear article according to the invention.

According to another embodiment of the invention, shown in FIG. 9, the use of light emitting diodes (LED) to aesthetically enhance the appearance of footwear and may be provided in combination with the other elements of the invention. One or more LEDs 58 may be sewn in the upper 14 behind the cartridge 18. The LED 58 may flash or alight for a prescribed period of time and can be of different colors. This produces a visually pleasant effect of the particulate matter moving against a lit background, and for example, may be used to facilitate the shoe being visible in the dark. Aside from the aesthetic benefit, this may have safety advantages, to allow pedestrians or cyclists to be visible to cars when there is little or no surrounding light.

FIGS. 10*a* to 10*e* show various embodiments of how the cartridge 18 may be connected to the upper (or other portions) of the shoe, in a replaceable manner to allow for a variety of cartridge appearances to be provided in an interchangeable manner.

Figure 10A:
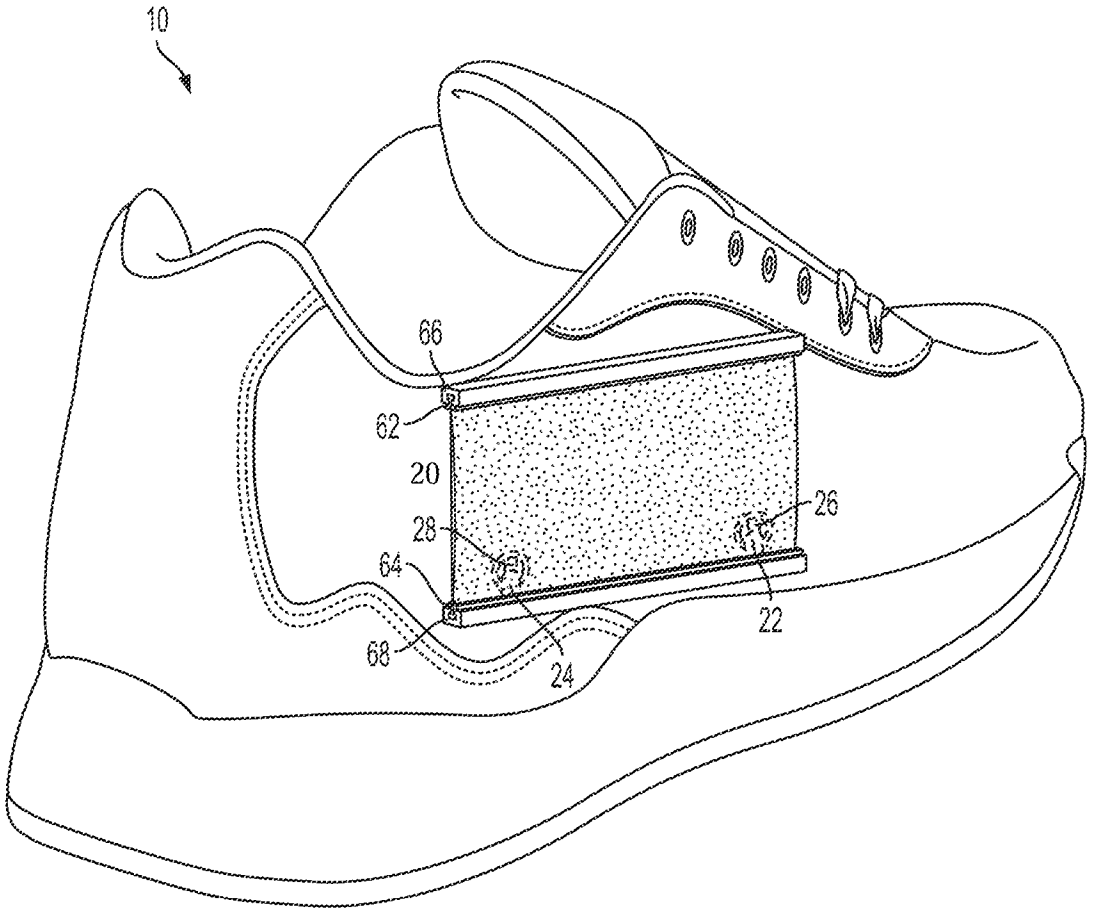
FIGS. 10A-10E show various illustrative embodiments of how a cartridge according to the invention could be connected to the footwear article of FIG. 1.

The embodiment of FIG. 10*a* shows the cartridge 18 coupled with the shoe 10 as by way of cartridge rails 62, 64, that are positioned into channels 66 and 68, preferably pre-manufactured on the upper 14 of the shoe 10. The rails 62 and 64 are slid into the channels 66, 68. The cartridge is then further secured, and connected to the fluid fluid circulating system of the invention, as the cartridge inlet tube 26 and cartridge outlet tube fixedly cohabit with the contoured ends of inlet tube 22 and outlet tube 24 on the shoe 10. Removal of the cartridge 18 may be accomplished by reversing the process, and sliding the cartridge off.

Figure 10B:
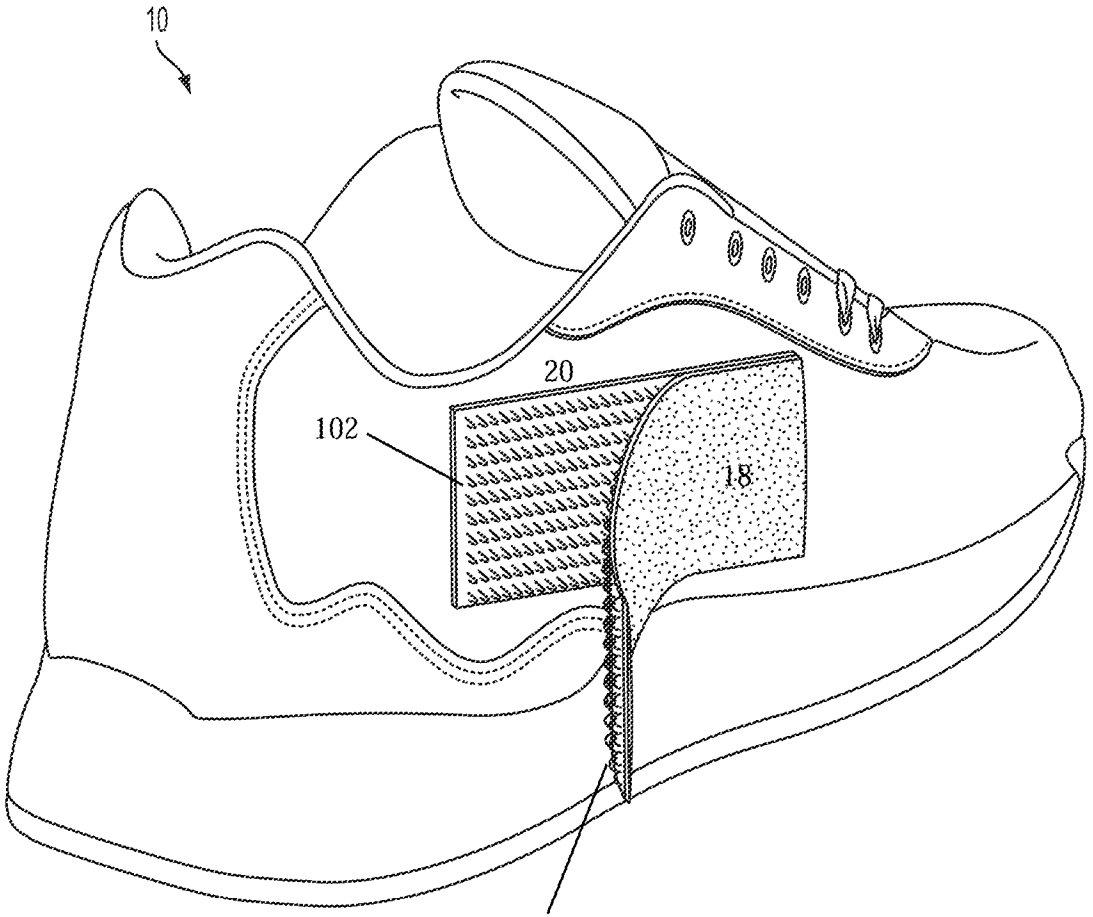

As shown in FIG. 10*b*, the cartridge 18 may be attached to the shoe 10 via use of a hook and loop or Velcro® fasteners. In this embodiment, one of the hook and loop portions 102 are provided on the shoe and the other of the hook and loop portions 104 are provided on the cartridge 18. The connection with the fluid circulating system may be accomplished in a manner corresponding to that shown in FIG. 10*a*.

Figure 10C:
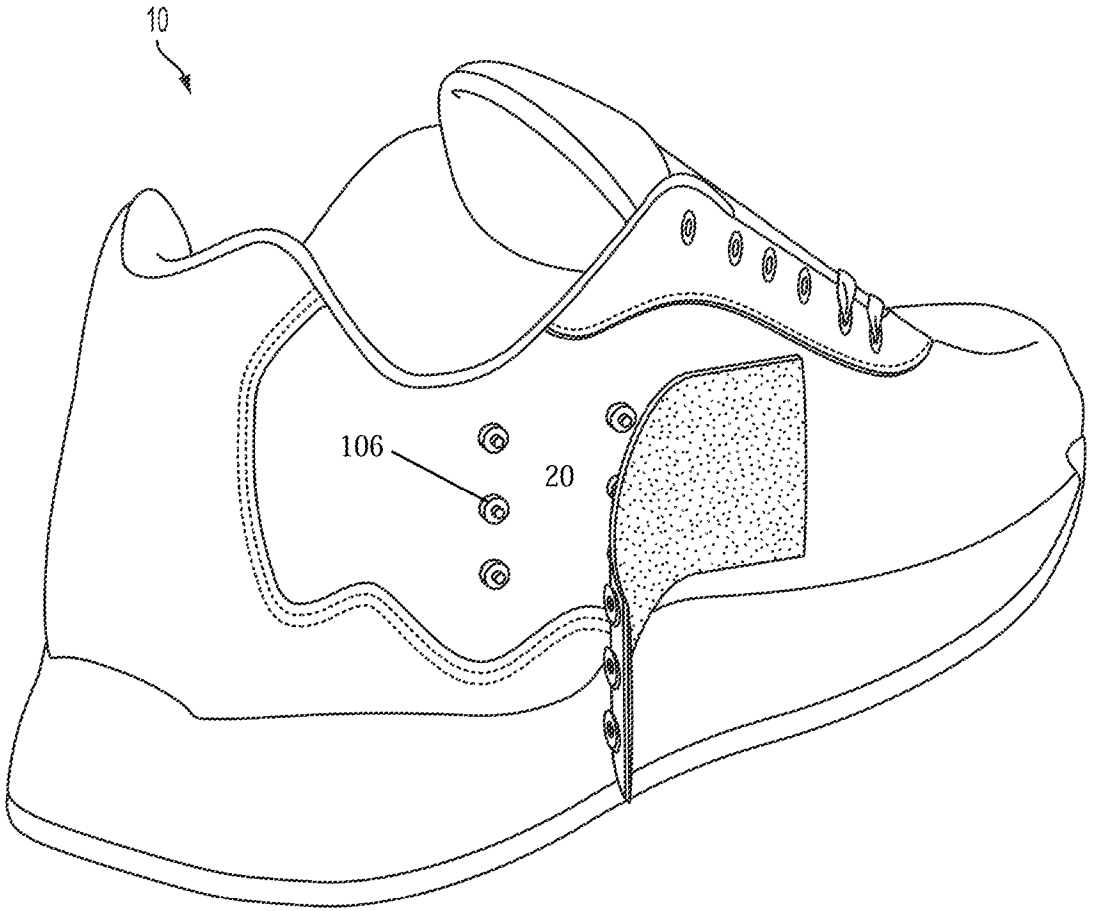
Figure 10D:
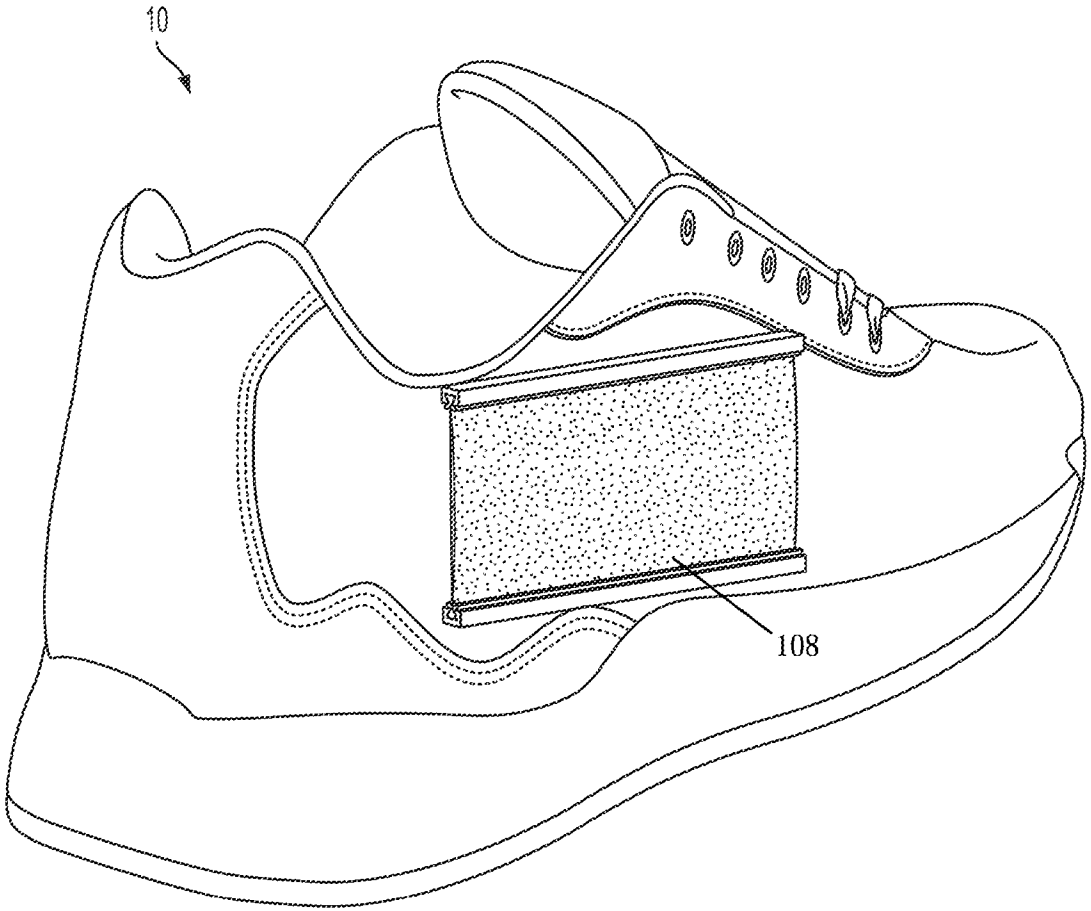
Figure 10E:
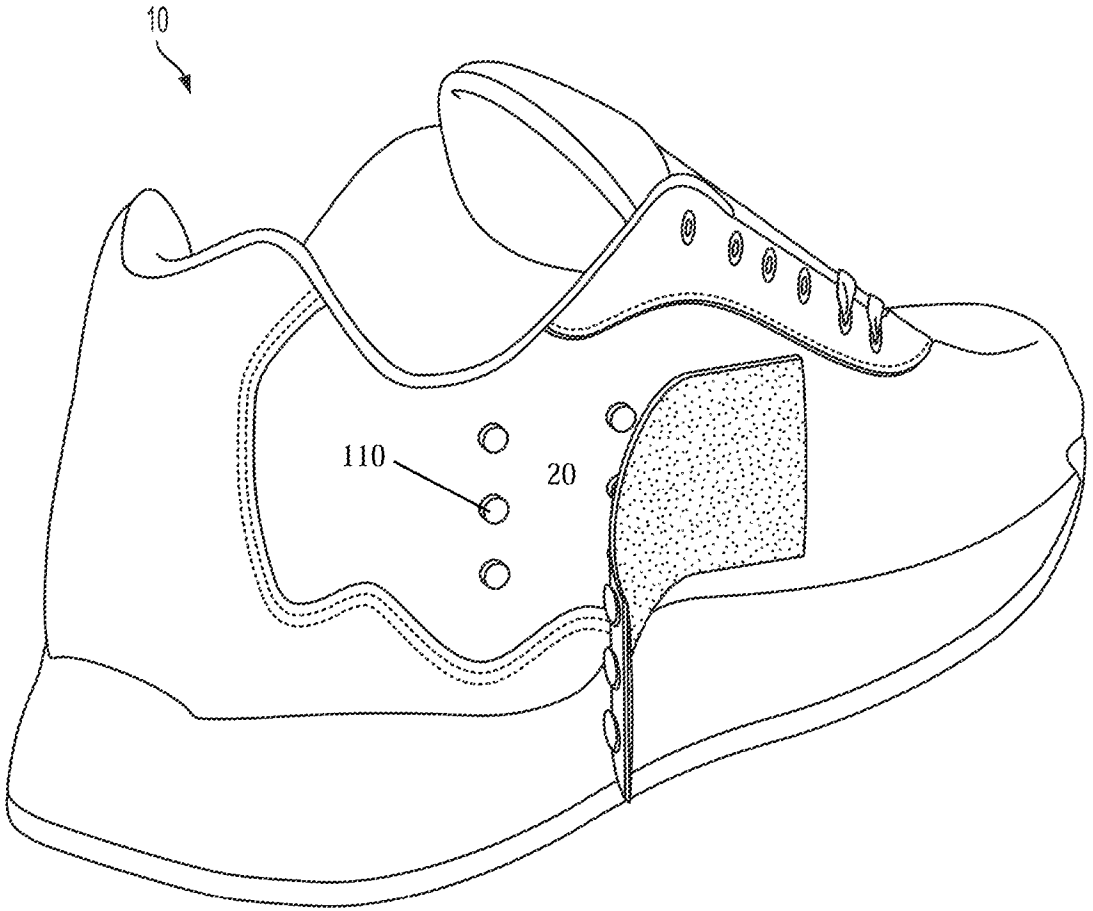

The embodiment of FIG. 10*c* shows the cartridge 18 may be fastened to the shoe via snap pins 106. FIG. 10*d* shows the cartridge clipping into the shoe using a tongue and groove clipping arrangement 108. FIG. 10*e* shows the use of magnets 110 to adhere the cartridge to the shoe. The connection with the fluid circulating system may be accomplished in a manner corresponding to that shown in FIG. 10*a*.

Figure 11:
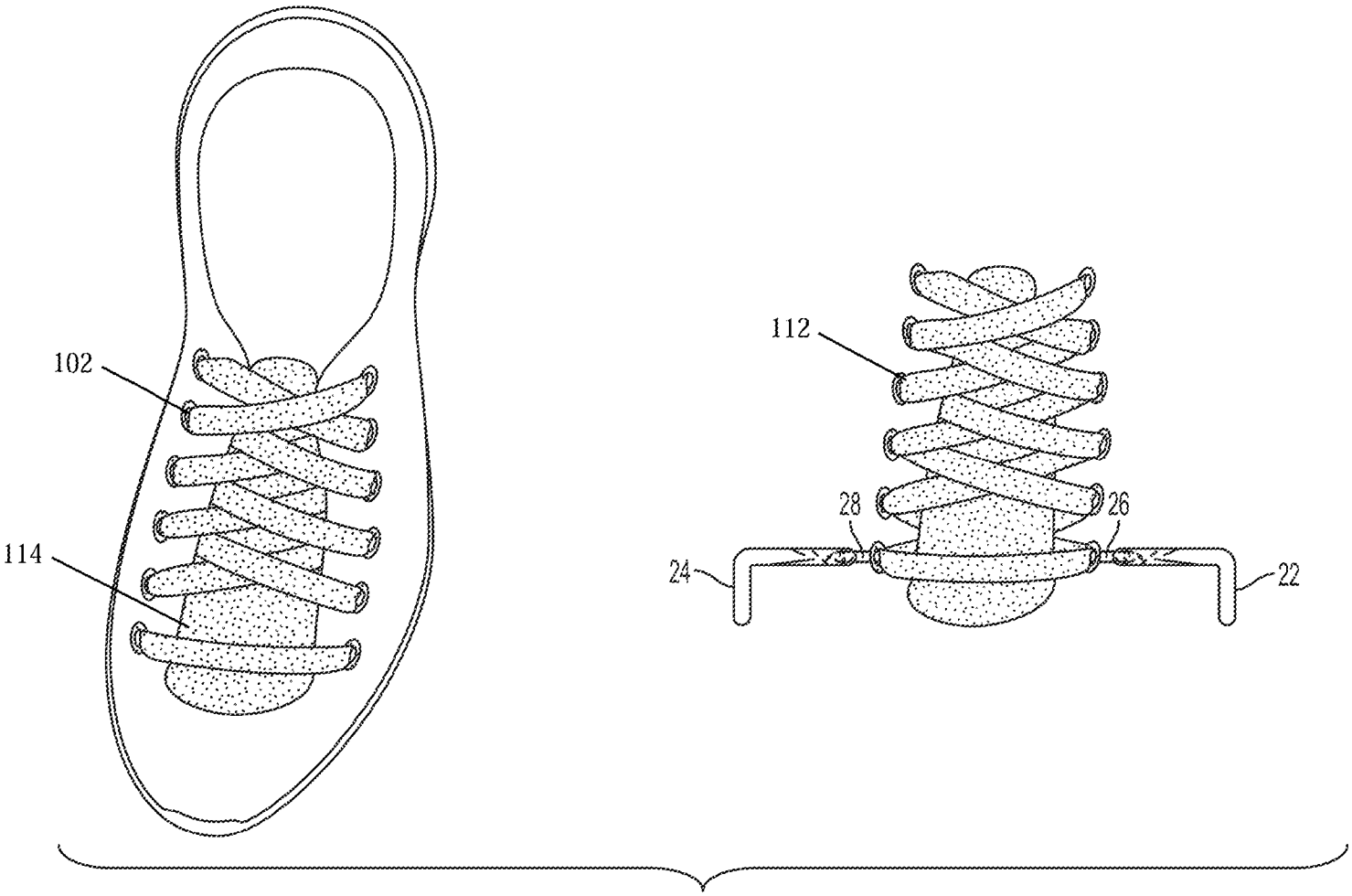
FIG. 11 shows another embodiment of the invention, wherein the cartridge is formed in the shape of shoelaces.

According to another preferred embodiment of the invention show in FIG. 11, the cartridge may be provided in the form of shoe laces 112 depicts the cartridge in the shape of laces of the footwear. Optionally, the cartridge portion may also include a tongue portion 114 of the shoe.

Alternatively, a cartridge may be permanently affixed to the shoe in the manufacturing process that may or may not incorporate the pump. In another instance, a cartridge may be permanently adhered to the upper, heel, toe or other areas of the shoe permanently and utilize a pump that will ensure the constant agitation of the suspended particulate sealably contained within the cartridge upon the wearer ambulating. A removably exchangeable cartridge or cartridges can be adhered to the shoe and not incorporate a pump.

Figure 12:
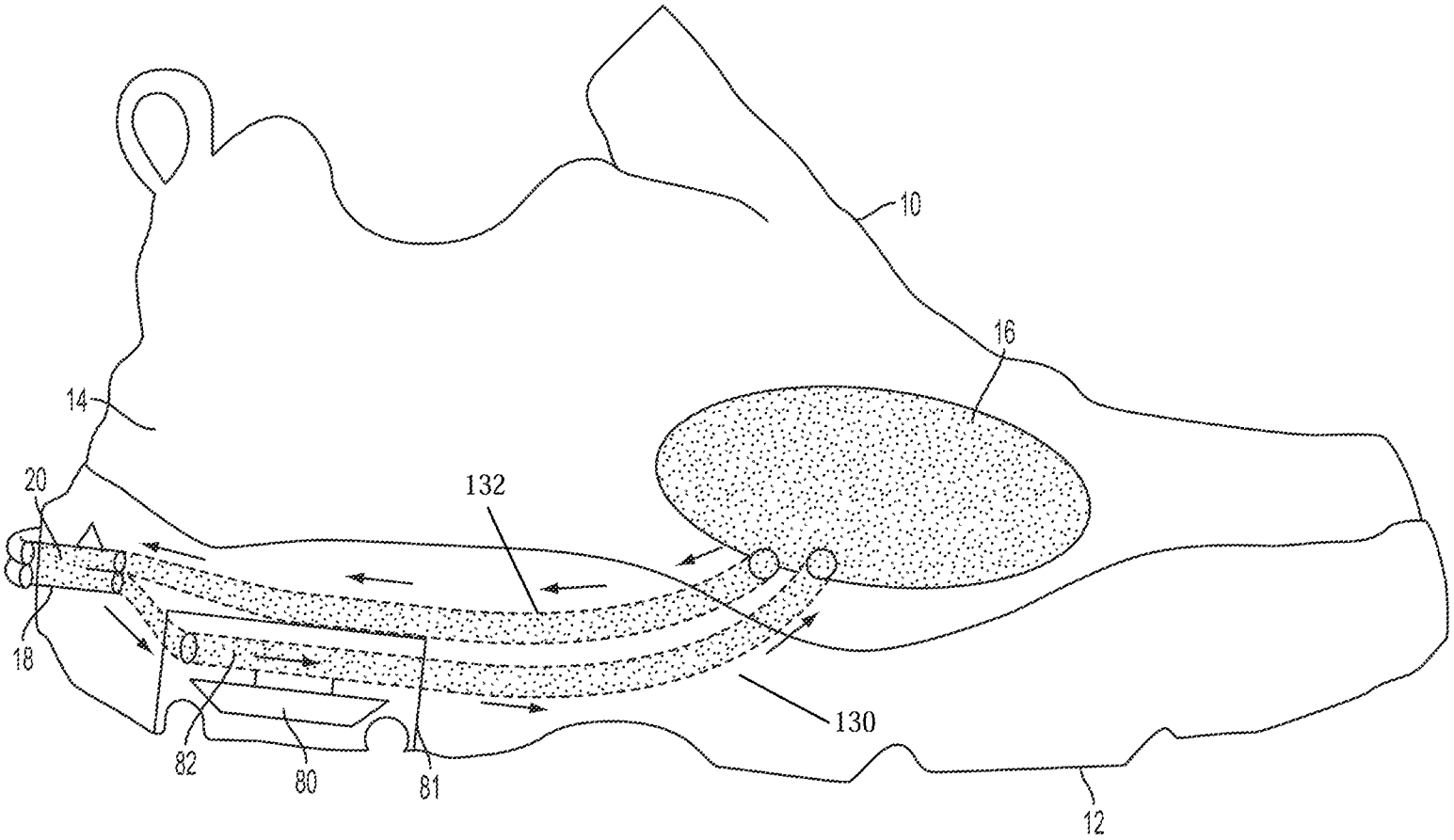
FIG. 12 shows another embodiment of the invention, wherein the upper includes transparent or translucent display areas.

According to another embodiment of the invention, shown in FIG. 12, there is shown an athletic shoe 10 that includes a sole 12, and an upper 14. The upper 14 is fixed with transparent or translucent hollow display areas 16. A cavity 18 at the rear of the shoe 10 is pre-formed to receive an exchangeable fluid cartridge 20. Embedded within the sole 12 is a plastic encased control unit 81 containing a power supply 80 and a micro pump 82. The exchangeable fluid cartridge 18 is operatively connected with the micro pump 82. An inlet tube 130 and an outlet tube 132 extend from the cartridge and may include all the elements described with respect to the connection between the pump and the cartridge of FIGS. 1 and 2.

The above-described embodiments are intended to be examples of the present invention and alterations and modifications may be effected thereto, by those of skill in the art, without departing from the scope of the invention that is defined solely by the claims appended hereto. For example, the filters herein described for preventing the particulate matter from entering the pump may be omitted altogether. The purpose for providing such filters is to eliminate contamination of particulate matter from one cartridge to the next, however, if the particulate matter to be used is the same for a given shoe, irrespective of the cartridge, then the filters are not necessary.

What is claimed is:

1. A footwear article having a sole portion, an upper portion, a heel portion, and an interior adapted for receiving a foot; said footwear article comprising:

a cartridge enclosing a fluid; said cartridge including a cartridge inlet and a cartridge outlet; wherein said cartridge encloses particulate matter suspendable in said fluid;

a fluid circulation system for circulating said fluid into said cartridge inlet and out of said cartridge outlet; said fluid circulation system including a pump having a pump inlet in fluid communication with said cartridge outlet and a pump outlet in fluid communication with said cartridge inlet; and, an inlet filter proximate said cartridge inlet and an outlet filter proximate said cartridge outlet; said inlet and outlet filters sized and otherwise dimensioned to prevent said particulate matter from being carried by said fluid out of said cartridge.

2. A footwear article according to claim 1, wherein said pump comprises a bellows pump.

3. A footwear article according to claim 1, wherein said pump comprises a micro pump.

4. A footwear article according to claim 1, further comprising an inlet tube having a first end connected to said cartridge inlet and a second end connected to said pump outlet and an outlet tube having a first end connected to said cartridge outlet and a second end connected to said pump inlet.

5. A footwear article according to claim 4, further comprising a pressure activated valve provided in each of said inlet and outlet tubes, wherein said pressure activated valves prevent movement of said fluid outside of said cartridge when said pump is inoperative.

6. A footwear article according to claim 1, wherein said cartridge is provided on one of said upper, said heel portion a*d or said interior of said footwear.

7. A footwear article according to claim 1, wherein said cartridge comprises an elongated flexible tube adapted to replace a shoelace.

8. A footwear article according to claim 1, wherein said cartridge further includes a fill port for injecting fluid into said cartridge.

9. A footwear article according to claim 8, wherein said fill port comprises a vacuum fill port and includes a self-sealing plug.

10. A footwear article according to claim 1, wherein said cartridge is made of a transparent, semi-transparent or translucent material.

11. A footwear article according to claim 1, wherein said cartridge is made of one or more materials selected from the group comprising polyvinyl chloride, thermoplastics, urethane, polycarbonate, acrylic, silicone and polypropylene.

12. A footwear article according to claim 1, wherein said cartridge further includes a convex surface portion.

13. A footwear article according to claim 1, further comprising at least one light source arranged to illuminate said fluid.

14. A footwear article according to claim 1, wherein said cartridge is removable from said footwear.

15. A footwear article according to claim 1, further comprising one or more channels formed on a surface of said upper; said cartridge including one or more rails adapted to be received in said one or more channels for securing said cartridge to said upper.

16. A footwear article according to claim 1, further comprising one portion of a hook and loop fastener on said upper; said cartridge including another portion of said hook and loop fastener for attaching said cartridge to said upper.

17. A footwear article according to claim 1, wherein said fluid is selected from the group comprising water, mineral oil, glycerin, glycol, saline and combinations thereof.

18. A footwear article according to claim 1, wherein said particulate matter is selected from the group comprising polyester glitter, acrylic polyesters, micas, bismuth ox chloride and combinations thereof.

* * * * *